US007410276B2

(12) United States Patent
Fryzek et al.

(10) Patent No.: US 7,410,276 B2
(45) Date of Patent: Aug. 12, 2008

(54) APPARATUS FOR SECURING A TRIM FRAME TO A RECESSED HOUSING MEMBER AND A METHOD OF MAKING THEREOF

(75) Inventors: Aaron P. Fryzek, Wheaton, IL (US); Aaron O'Brien, Munster, IN (US)

(73) Assignee: Juno Manufacturing, Inc., Des Plaines, IL (US)

( * ) Notice: Subject to any disclaimer, the term of this patent is extended or adjusted under 35 U.S.C. 154(b) by 268 days.

(21) Appl. No.: 11/217,190

(22) Filed: Aug. 31, 2005

(65) Prior Publication Data

US 2007/0047241 A1 Mar. 1, 2007

(51) Int. Cl.
*F21S 8/06* (2006.01)

(52) U.S. Cl. ..... 362/408; 362/365; 267/158

(58) Field of Classification Search ..... 248/343, 248/565, 576, 614, 617, 618; 267/158, 160, 267/165, 164, 163, 159; 362/408, 365, 368; 174/50

See application file for complete search history.

(56) References Cited

U.S. PATENT DOCUMENTS 3,169,007 A * 2/1965 Duffy et al. ..... 248/343
5,957,572 A 9/1999 Wedekind et al.
6,030,102 A 2/2000 Gromotka
6,719,438 B2 4/2004 Sevack et al.
6,896,394 B2 5/2005 Houle

FOREIGN PATENT DOCUMENTS

GB 1185924 A * 6/1967

OTHER PUBLICATIONS

International Search Report and Written Opinion corresponding to PCT/US2005/30920 dated Feb. 23, 2006.

* cited by examiner

*Primary Examiner*—A. Joseph Wujciak, III
(74) *Attorney, Agent, or Firm*—Sonnenschein Nath & Rosenthal LLP

(57) ABSTRACT

An apparatus is provided for securing a trim frame to a housing member in a recessed lighting fixture. The apparatus includes a spring associated with the trim frame having a top edge, a left edge, a right edge, and a bottom edge, a left portion, a right portion, and a center portion between the left portion and the right portion. The left portion is connected to the center portion along a first bend, and the right portion is connected to the center portion along a second bend. The left portion includes a first lead-in portion formed by a third bend and a first retention portion formed by a fourth bend, and the right portion includes a second lead-in portion formed by a fifth bend and a second retention portion formed by a sixth bend.

13 Claims, 6 Drawing Sheets

APPARATUS FOR SECURING A TRIM FRAME TO A RECESSED HOUSING MEMBER AND A METHOD OF MAKING THEREOF

FIELD OF THE INVENTION

The present invention relates generally to lighting fixtures and in particular to installation of downlights.

BACKGROUND ART

Typical recessed lighting fixtures include a recessed housing and a trim frame that is received in the recessed housing. Numerous types of devices have been used in an effort to securely and firmly retain the trim frame in the recessed housing.

One commonly used method for retaining the trim frame in the housing member are torsion springs. However, a significant amount of labor is required to install or remove a trim frame when using the torsion springs. For example, torsion springs must be "engaged" in a slot or bracket before pushing the trim into place, and "disengaged" before completely removing the finishing trim from the recessed housing. Torsion springs also tend to interfere with compact recessed housings leading to insufficient retention in certain applications.

Another known method for retaining a trim frame is using horizontal mounted flat springs. These types of springs exert forces on the sidewall of the recessed housings to retain the finishing trims in place. Horizontal mounted flat springs tend to remain where initially positioned, and do not allow for vertical housing flex when installing. Finishing trims equipped with these style springs are also difficult to remove since considerable force is often required to overcome the spring and reverse it's direction. This can lead to distortion of the trim and/or housing. Typically, these types of springs can also only be used with a smooth recessed housing since various holes and mounting slots can interfere with the spring, resulting in the springs sticking in the housing.

Another known method for retaining a trim frame is to use vertical mounted tall thin flat springs. These springs hold the finishing trim in the housing through spring pressure applied on the sidewall of the recessed housing around 2" up from the bottom of the housing. These springs typically include sharp edges that gouge the recessed housing to improve retention of the trim. These springs are also usually only compatible with straight wall solid recessed housing cans and any holes or edges in the recessed housing will catch on the spring resulting in the trim getting stuck upon removal. Finishing trims that contain these type of springs also cannot typically contain features to "pull up" the trim towards the housing, so there is a better chance for a gap between the ceiling and the trim.

Yet another method for retaining a trim frame to a housing member are vertical mounted short acute angle flat springs. These type of springs are usually under 2" high, and are made from a uniform width strip formed over 90° so the portion of the spring that provides tension is lower and towards the base of the finishing trim. These types of springs retain the finishing trim in the recessed housing by spring pressure in the lower portion of the recessed housing sidewall. As these springs are formed into an inverted "v" shape, the surface acts as a lead in when installing the finishing trim into a recessed housing, so they are aligned without additional preforming or manually lining up the springs. However, trims containing these type of springs do not typically contain features to "pull up" the trim towards the housing, so there is a better chance that a gap between the ceiling and the trim will be present. The styles of trims, which use this style of spring, are also somewhat limited. In order for this type of spring to be used, there must be a generous gap between the lamp retainer/reflector and the housing sidewall. The spring does not fully flatten, therefore finishing trims with reflectors or lamp holder rings that are close to the sidewall of the housing cannot be equipped with this type of spring.

Finally, another common means for retaining the trim frame are vertical mounted wide flat springs. These springs are usually made from a wide strip of thin material, where the width of the spring is larger than the height. When finishing trims are installed into recessed housings with this type of spring, they are held in place by the spring pressure on the sidewall of the housing after cylindrical compression of the spring for insertion. Various designs contain forms or bends to increase retention, ease installation and removal, and increase the "pull up" towards the ceiling. Although trims with this style of spring usually have good retention, these springs require secondary alignment and pre-compression of the spring prior to installation into the recessed housing.

Accordingly, there is a need for a device for retaining a trim frame in a recessed housing that overcomes the drawbacks of the various springs described above.

SUMMARY OF THE INVENTION

The present invention is an apparatus for securing a trim frame to a housing member in a recessed lighting fixture comprising. The apparatus includes a spring physically associated with the trim frame. The spring has a top edge, a left edge, a right edge, and a bottom edge, a left portion, a right portion, and a center portion between the left portion and the right portion. The left portion is connected to the center portion along a first bend extending substantially parallel to a vertical centerline of the spring from the top edge to the bottom edge and the right portion is connected to the center portion along a second bend extending substantially parallel to the vertical centerline of the spring from the top edge to the bottom edge.

The left portion has a first lead-in portion formed by a third bend extending from the top edge to the left edge and a first retention portion formed by a fourth bend extending from the bottom edge to the left edge. The right portion also has a second lead-in portion formed by a fifth bend extending from the top edge to the right edge and a second retention portion formed by a sixth bend extending from the bottom edge to the right edge.

The apparatus may also include an indented surface along an interior surface of the cylindrical housing. The indented surface is positioned within the cylindrical housing such that at least a part of the retention portions of the spring are located above the indented surface when the trim frame is received in the cylindrical housing.

In another aspect of the invention, the present invention includes a method for forming an apparatus for securing a trim frame to a housing member in a recessed lighting fixture. The method includes the steps of providing a material having a generally rectangular shape, the material having a top edge, a bottom edge, a left edge, and a right edge; bending the first material at first and second bends to form a left portion, a right portion, and a center portion between the left and right portions, the first and second bends formed in a direction substantially parallel to a vertical centerline of the material; bending a part of the material in the left portion along a third bend extending from a top edge of the spring to a left edge of the spring; bending a part of the material in the left portion along a fourth bend extending from a bottom edge of the spring to the left edge of the spring; bending a part of the material in the right portion along a fifth bend extending from a top edge of the spring to a right edge of the spring; and bending a part of the material in the right portion along a sixth bend extending from a bottom edge of the spring to a right edge of the spring The present invention provides numerous advantages. First, the present invention allows for easy installation and removal of trim frames from recessed fixture housings. The lead-in portions of the springs aligns and guides the trim into place, and the retention portions of the spring both retain the trim frame and double as a lead-out helping to overcome the retention portions of the recessed housing.

The present invention also provides constant tension after installation of the recessed lighting fixture. When trim frames containing the spring are installed into the recessed housing as intended, the angular retention portions of the springs are constantly exerting spring pressure on the corresponding recessed housing features. This results in the trim frame "pulling up" to the ceiling, wall or other mating surface after installation, giving an aesthetically pleasing appearance and preventing the finishing trim from loosening from the ceiling surface.

As the spring has a low profile, it is also compatible with many different styles of finishing trims. In a recessed light fixture housing, the internal components, such as the lamp holder, reflector, additional trim components, or various other types of components and mechanisms can come within close proximity to the sidewall of the recessed housing without effecting spring performance.

Due to how the spring functions in relationship to the corresponding features of the recessed housing, the trim frame also provides adequate retention under various mounting conditions, including various thickness ceilings, mounting height of recessed housing, and movement or flexing of the recessed housing.

Finally, the present invention also works with various housing types. Due to the shape of the spring, the recessed housing can be made from various materials and contain numerous slots or holes which do not effect spring performance. This results in a universal spring that can be applied in many applications for a flexible product line.

DETAILED DESCRIPTION

The present invention is generally directed to a spring intended to be mechanically fastened to a rigid part of a trim frame for a recessed lighting fixture, which in-turn, is inserted into a housing member or container. The trim frame is held firmly to the ceiling, wall or mating surface via springs and corresponding housing features. These springs allow the trim frame to be installed and removed easily without the requirement for additional tools, and without damaging the mating recessed light fixture housing.

Figure 1:
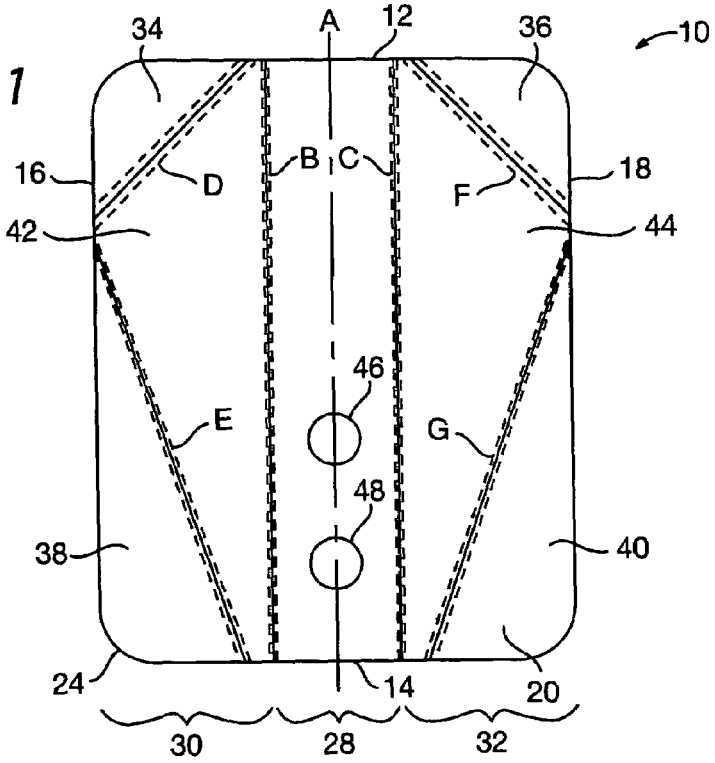
FIG. 1 is a flat view of one embodiment of the spring according to the present invention (prior to forming)
Figure 2:
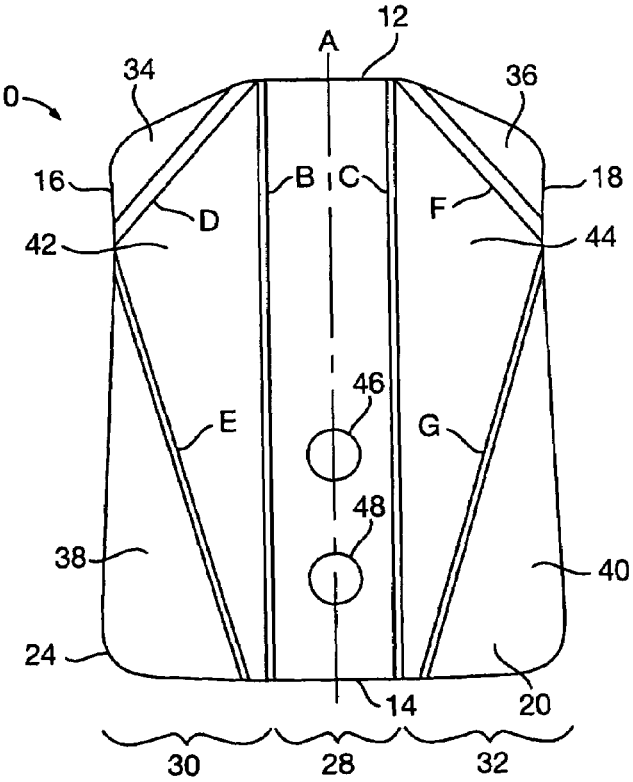
FIG. 2 is a front view of one embodiment of the spring according to the present invention.
Figure 3:
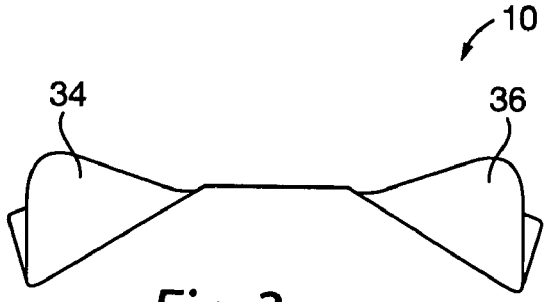
FIG. 3 is a top view of one embodiment of the spring depicted in FIG. 2.
Figure 4:
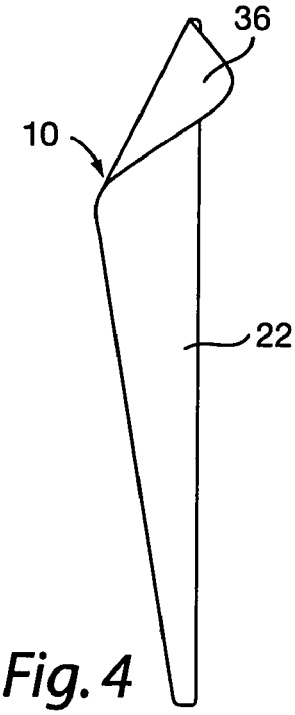
FIG. 4 is a side view of one embodiment of the spring depicted in FIG. 2.

FIGS. 1 through 4 illustrate one embodiment of a spring 10 according to the present invention. The spring 10 is preferably constructed form a single rectangular blank of thin gauge steel, as shown in FIG. 1. FIGS. 2 through 4 then illustrate the spring as formed from the rectangular blank in the manner discussed below.

The spring 10 includes four perimeter edges, a top edge 12, a bottom edge 14, a left edge 16, and a right edge 18. The spring also includes a first surface 20 and a second surface 22 (shown in FIG. 4). In one embodiment, the top and bottom edges are approximately 1.3 inches in length, the left and right edges are approximately 1.675 inches in length, and the thickness of the spring (i.e. the distance between the first and second surfaces 20 and 22) is 0.008 inches. The four corners 24 of the spring 10 are also preferably rounded. In one embodiment, the radius of curvature of each of the four corners is 0.125 inches.

The spring also includes a center portion 28, a left portion 30, and a right portion 32. The left portion 30 intersects the center portion 28 at a bend B and the right portion 32 intersects the center portion 28 at a bend C. Bends B and C are preferably continuous from the top edge 12 to the bottom edge 14 in a direction substantially parallel to the vertical centerline A of the spring. The left and right portions 30 and 32 are also preferably bent in a direction towards the first surface 20 of the spring 10 to form angles of approximately 31 degrees each between the left and right portions and the center portion. In one embodiment, the width of the center portion is 0.350 inches and the widths of the left and right portions 30 and 32 are 0.475 inches.

Bends B and C, which are also referred to hereafter as "stiffening bends," serve to make the spring 10 rigid. Since the stiffening bends fall along the entire vertical length of the part in two places, the spring 10 resists deformation along any horizontal plane from forces that may be applied on the spring when installing a trim frame into a recessed housing. The spring 10 is then weaker along the vertical direction, resulting in cylindrical like compression perpendicular to these bends. The stiffening bends also serve to provide the proper positioning for the additional bends that form the lead-in and retention portions, as described below.

Each of the left and right portions 30 and 32 include a lead-in portion 34 and 36, a retention portion 38 and 40, and a middle portion 42 and 44, respectively. The lead-in portion 34 in the left portion 30 intersects the middle portion 42 at a bend D which extends from the top edge 12 to the left edge 16. In one embodiment, bend D begins at a point along the top edge 0.220 inches from the vertical centerline A and extends towards the left edge 16 at a 45 degree angle to the top edge. The lead-in portion 34 is also preferably bent in a direction towards the second surface 22 of the spring 10 and forms and an angle of approximately 80 degrees with the middle portion 42.

The retention portion 38 in the left portion 30 intersects the middle portion 42 at a bend E which extends from the bottom edge 14 to the left edge 16. In one embodiment, bend E begins at a point along the bottom edge 0.2555 inches from the vertical centerline A and extends towards the left edge at a 71 degree angle to the bottom edge. The retention portions 38 is also preferably bent in a direction towards the second surface 22 of the spring 10 and forms an angle of approximately 30 degrees with the middle portion 42.

The lead-in surface 36 and the retention portion 40 in the right portion of the spring 10 are formed similarly to the those in the left portion such that the left and right portions are symmetrical about the vertical centerline A. Specifically, the lead-in portion 36 in the right portion 32 intersects the middle portion 44 at a bend F which extends from the top edge 12 to the right edge 18. In one embodiment, bend F begins at a point along the top edge 0.220 inches from the vertical centerline A and extends towards the right edge 18 at a 45 degree angle to the top edge. The lead-in portion 36 is also preferably bent in a direction towards the second surface 22 of the spring 10 and forms and an angle of approximately 80 degrees with the middle portion 44. The retention portion 40 in the right portion 32 intersects the middle portion 44 at a bend G which extends from the bottom edge 14 to the right edge 18. In one embodiment, bend G begins at a point along the bottom edge 0.2555 inches from the vertical centerline A and extends towards the right edge at a 71 degree angle to the bottom edge. The retention portions 40 is also preferably bent in a direction towards the second surface 22 of the spring 10 and forms an angle of approximately 30 degrees with the middle portion 44.

The center portion 28 of the spring 10 may also include two mounting holes 46 and 48 to allow the spring 10 to be mechanically secured to the trim frame. In one embodiment, the mounting holes 46 and 48 each have a diameter of 0.136 inches. The center of each of the mounting holes 46 and 48 are also preferably located along the vertical centerline A with the centers of the mounting holes being 0.350 inches apart from one another.

Although specific parameters and measurements have been provided for the embodiment described above, one skilled in the art would understand that these parameters and measurements may be altered for use with different recessed fixture configurations. As examples, the height and width of the spring may be made larger or smaller. Depending on the size of the spring, the dimensions for the various bends may also be altered. The blank used to form the spring may also be of a shape other than a rectangle. The spring may also contain only one mounting hole or more than two mounting holes.

Figure 5:
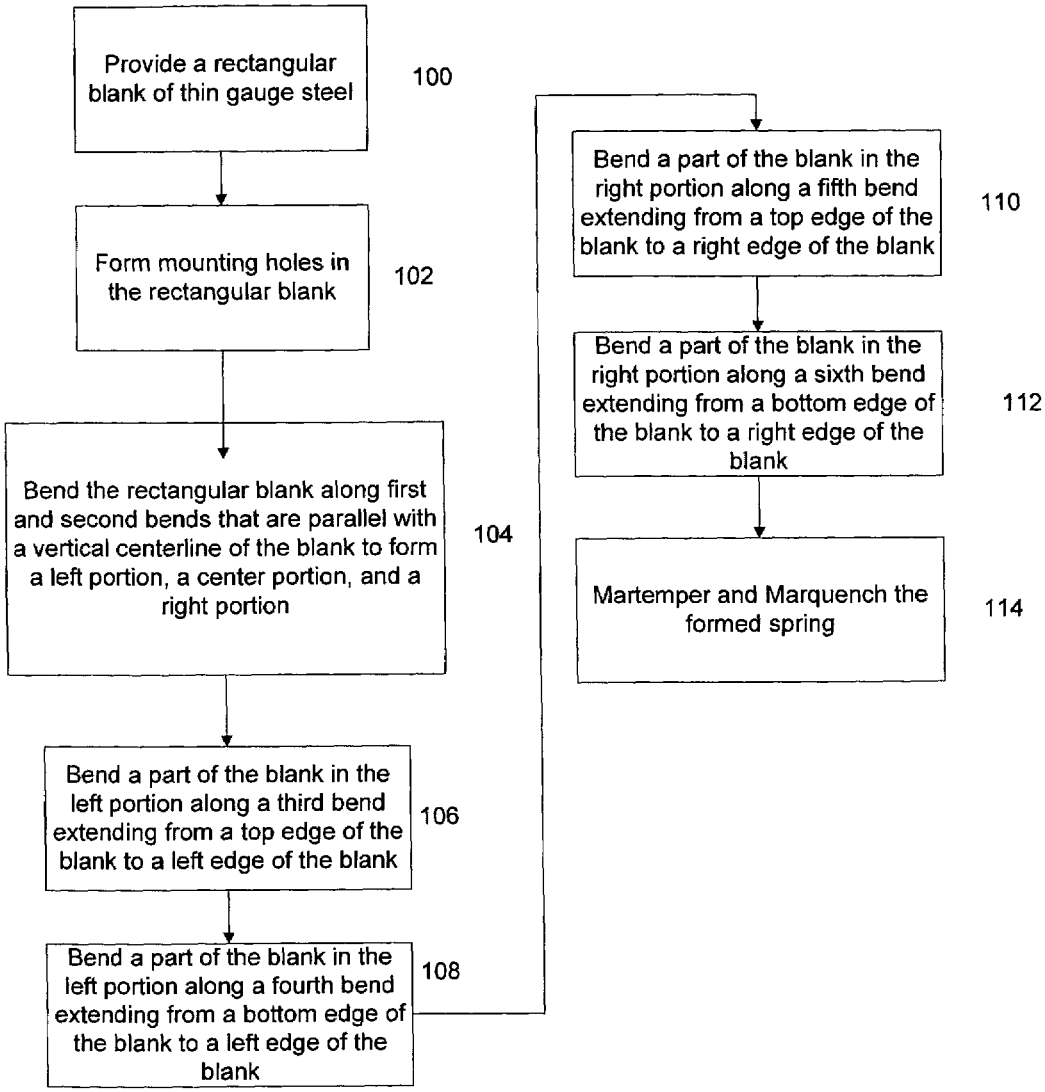
FIG. 5 is a flowchart illustrating a method for making the spring in FIG. 2.

FIG. 5 illustrates one method for making the spring 10 described above. In step 100, a rectangular blank of thin gauge spring steel is provided. In step 102, two apertures are formed in the spring along the vertical centerline A to form the mounting holes. The mounting holes may be formed by drilling the holes into the rectangular blank, stamping the holes, or using any other well known method.

The spring 10 is then formed by making six different bends in the rectangular blank. In step 104, the rectangular blank is bent along bends B and C in a direction parallel to the vertical centerline A of the spring, forming a center portion 28, a left portion 30, and a right portion 32. In step 106, the spring is bent along a bend D extending from a top edge of the spring to a left edge of the spring to form a first lead-in portion 34. In step 108, the spring is bent along a bend E extending from a bottom edge of the spring to a left edge of the spring to form a first retention portion 38. In step 110, the spring is bent along a bend F extending from a top edge of the spring to a right edge of the spring to form a second lead-in portion 36. In step 12, the spring is bent along a bend G extending from a bottom edge of the spring to a right edge of the spring to form a second retention portion 40. The bends made in step 104 are preferably made in a direction opposite to that of the bends made in steps 106-112. Although FIG. 4 illustrates the steps for forming the bends and the mounting holes in one order, it is understood that the spring may also be formed by performing these steps in any other order.

Once the spring is formed, the spring is then martempered and marquenched (step 114). This provides sufficient mechanical strength and spring temper for use of the spring in the desired applications such as recessed lighting fixtures. In one embodiment, the spring is martempered and marquenched to a range of 53 to 55 Rockwell C. One such known process for performing the martempering and marquenching is the SC-4 process by FPM Heat Treating, Inc.

Figure 6:
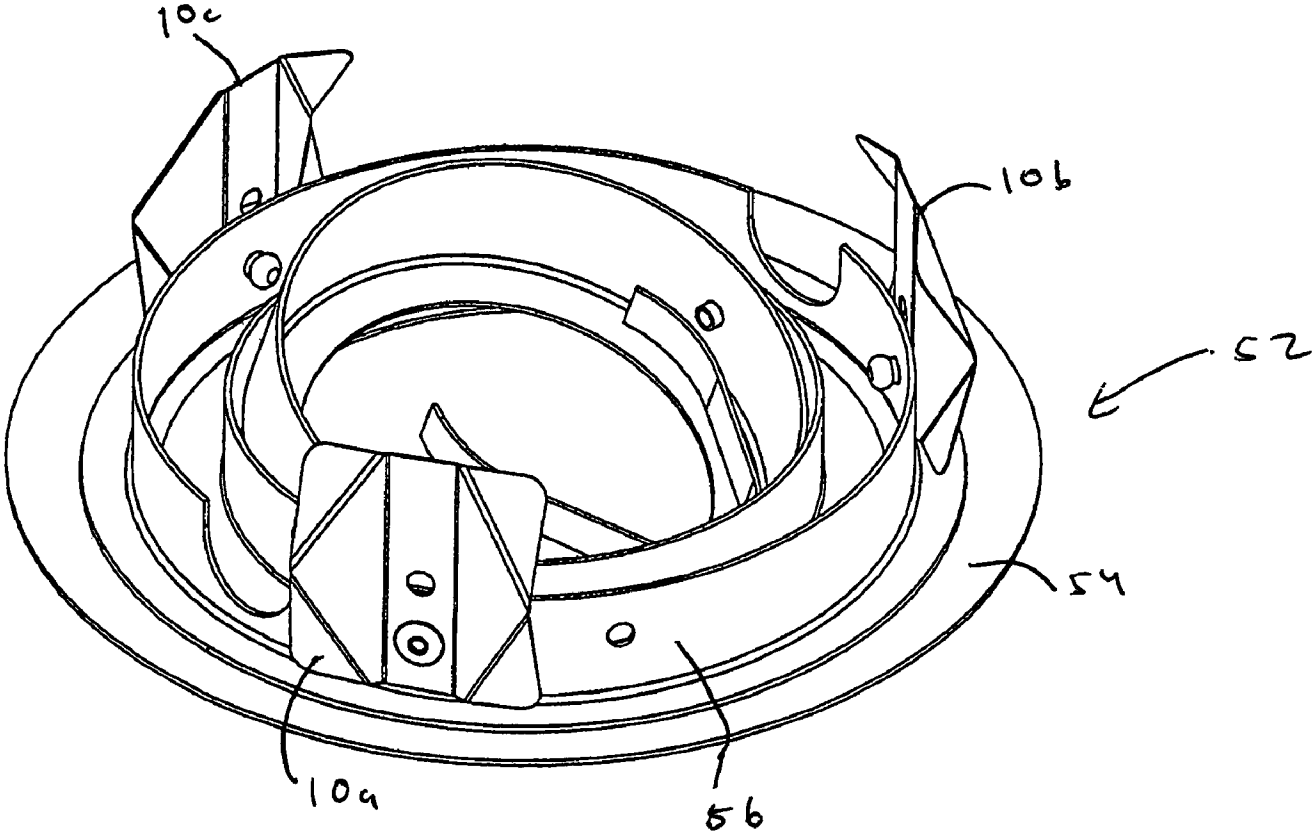
FIG. 6 is a perspective view of one embodiment of the spring mounted on a trim frame according to the present invention.
Figure 7:
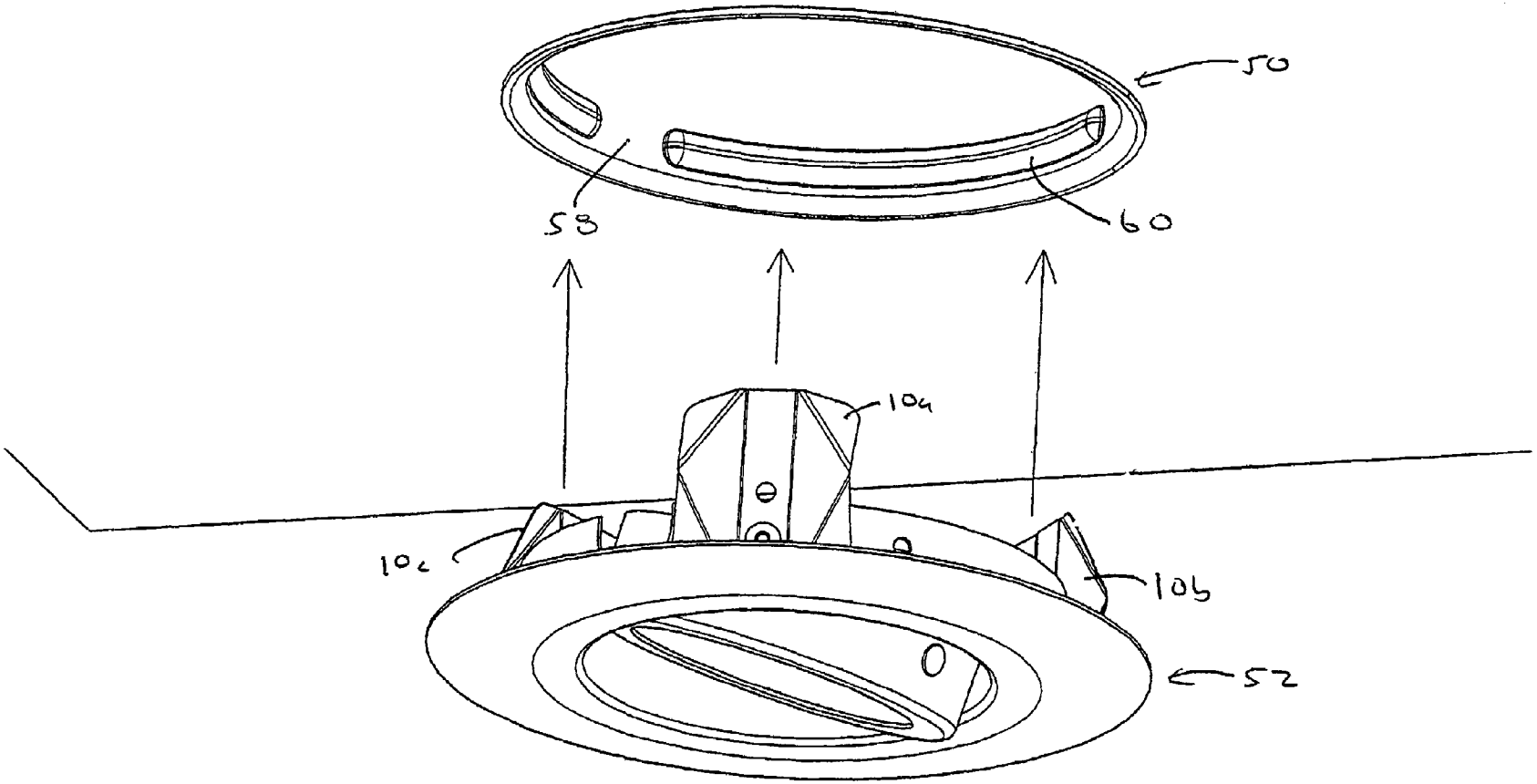
FIG. 7 illustrates one embodiment of a trim frame and a recessed housing according to the present invention.
Figure 8:
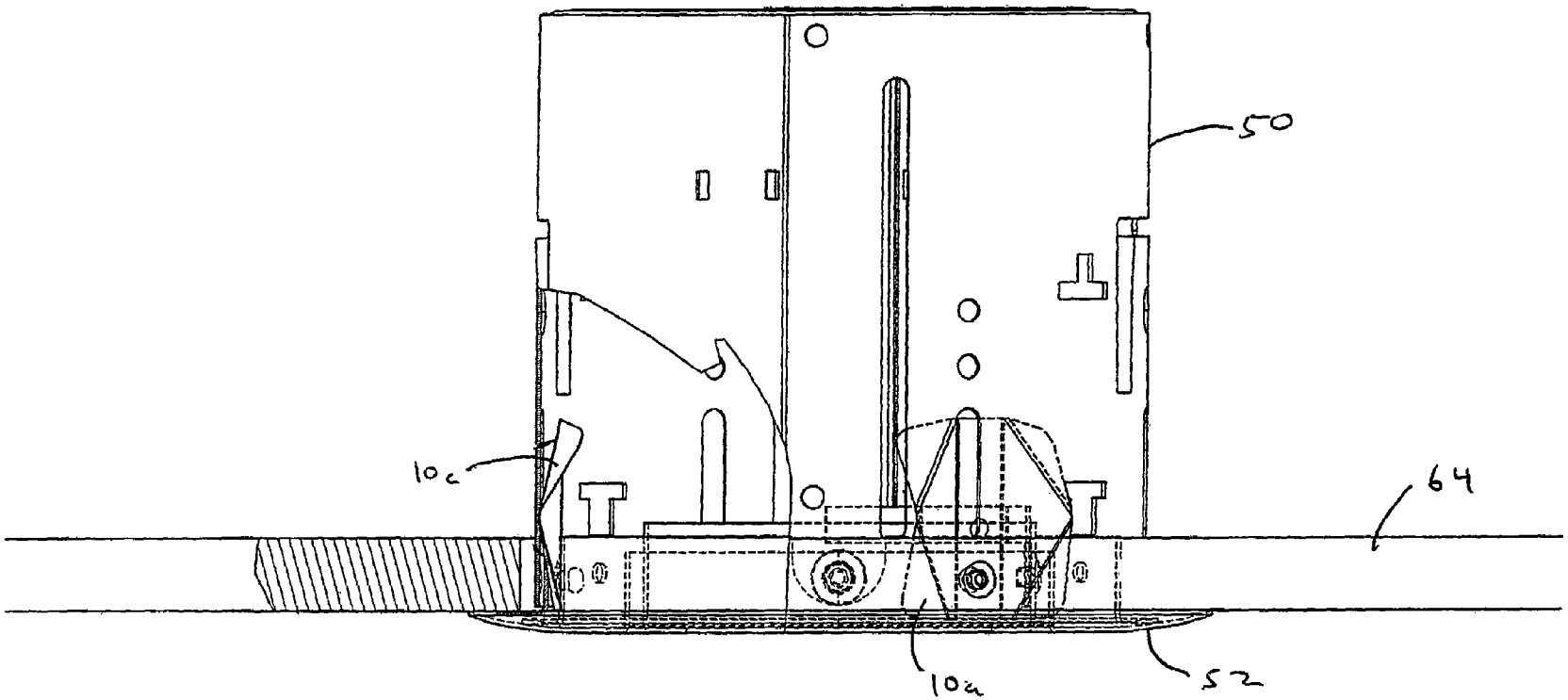
FIG. 8 illustrates one embodiment of a trim frame inserted into a recessed housing according to the present invention.

FIGS. 6 through 8 illustrate springs 10*a*, 10*b* and 10*c* in use with a recessed lighting fixture. As is generally known in the art, a recessed lighting fixture includes a cylindrical housing member 50 that is designed to be inserted through a hole in a ceiling. The recessed lighting fixture also includes a trim frame 52 that is then configured to be inserted into the housing.

As shown in FIG. 6, the trim frame 52 includes a flange 54 and a cylindrical wall 56 along the interior edge of the flange 54. The spring 10 may be mounted to the cylindrical wall 52 via the mounting holes 46 and 48 using rivets, bolts, screws, or any other known means. As shown in FIG. 5, three springs 10 are preferably mounted to the trim frame 52, although different a different number of springs may be used. The spring 10 may also be mounted to other rigid portions of the trim frame so long as the spring are capable of coming on contact with the interior surface 58 of the housing member 50 upon insertion of the trim into the housing member.

As shown in FIG. 7, the housing member 50 is generally cylindrical in shape, although other shapes may be used so long as the trim frame shape is similarly altered. Along its interior surface 58, the housing member preferably includes an indented surface 60 that is indented toward the interior of the housing member. This indented surface 60 may be formed integral to the cylindrical housing or as an additional component. The indented surface slightly reduces the opening size intended for finishing trim insertion, such that when the retention portions of the spring overcome the indented surface, the trim frame is held securely into the recessed housing.

When the trim frame 52 is inserted into the housing member 50, springs 10*a*, 10*b*, and 10*c* function to hold the trim frame firmly to the ceiling, wall or mating surface 64, as shown in FIG. 8. More particularly, during installation of the trim frame into the cylindrical housing, the lead-in portions 30 and 32 initially deform and guide the trim frame into the proper position for retention. The retention portions 38 and 40 then provide the spring/trim frame assembly with retention and "pull up" into the recessed housing and for easy removal of the trim frame from the recessed housing.

The relationship between the position of the retention portions of the spring and the indented surface, in combination with the vertical cylindrical compression of the spring, provides forces such that the trim frame is always "pulling up" towards the finished ceiling, wall or mating surface, resulting in a secure fit with little or no gap between the trim frame and the corresponding ceiling, wall or mating surface. When removing the trim frame from the recessed housing, the angular orientation of this retention portions also permits the lip feature in the recessed housing to be easily overcome.

While various embodiments of the application have been described, it will be apparent to those of ordinary skill in the art that many more embodiments and implementations are possible that are within the scope of this invention. Accordingly, the invention is not to be restricted except in light of the attached claims and their equivalent.

What is claimed is:

1. An apparatus for securing a trim frame to a housing member, both the trim frame and the housing member being parts of a recessed lighting fixture, comprising:

a spring having a top edge, a left edge, a right edge, a bottom edge, a left portion, a right portion, and a center portion between the left portion and the right portion, wherein the left portion is connected to the center portion along a first bend extending substantially parallel to a vertical centerline of the spring from the top edge to the bottom edge, the right portion is connected to the center portion along a second bend extending substantially parallel to the vertical centerline of the spring from the top edge to the bottom edge, the left portion has first lead-in portion formed by a third bend extending from the top edge to the left edge and a first retention portion formed by a fourth bend extending from the bottom edge to the left edge, the right portion has a second lead-in portion formed by a fifth bend extending from the top edge to the right edge and a second retention portion formed by a sixth bend extending from the bottom edge to the right edge, and the spring, which is detachably affixed to the trim frame via the center portion, is received by the housing member to secure the trim frame to the housing member.

2. The apparatus of claim 1 wherein the center portion includes at least one mounting hole.

3. The apparatus of claim 2 wherein the center portion includes two mounting holes.

4. The apparatus of claim 1 wherein the left portion and the center portion form an angle of approximately 31 degrees.

5. The apparatus of claim 4 wherein the right portion and the center portion form an angle of approximately 31 degrees.

6. The apparatus of claim 5 wherein the first lead-in portion forms an angle of approximately 80 degrees with a portion of the left portion.

7. The apparatus of claim 6 the first retention portion forms an angle of approximately 30 degrees with a portion of the left portion.

8. The apparatus of claim 7 wherein the second lead-in portion forms an angle of approximately 80 degrees with a portion of the right portion.

9. The apparatus of claim 8 wherein the second retention portion forms an angle of approximately 30 degrees with a portion of the right portion.

10. The apparatus of claim 9 wherein the housing member includes an indented surface along the interior surface of the housing member, the indented surface being positioned within the housing member such that at least a part of the first and second retention portions of the spring are located above the indented surface when the spring is received in the housing member.

11. The apparatus of claim 1, wherein the spring is martempered and marquenched.

12. The apparatus of claim 11 wherein the spring is martempered and marquenched to a range of approximately 53 to 55 Rockwell C.

13. The apparatus of claim 1 wherein the spring has a first surface and a second surface, and the thickness of the spring between the first surface and the second surface is approximately 0.008 inches.

* * * * *